US006230605B1

(12) United States Patent
Kownacki

(10) Patent No.: US 6,230,605 B1
(45) Date of Patent: May 15, 2001

(54) PISTON-TO-CYLINDER SEAL FOR A PNEUMATIC ENGINE

(75) Inventor: Charles D. Kownacki, Erie, PA (US)

(73) Assignee: Spin Master Toys, Toronto (CA)

( * ) Notice: Subject to any disclaimer, the term of this patent is extended or adjusted under 35 U.S.C. 154(b) by 0 days.

(21) Appl. No.: 09/613,569

(22) Filed: Jul. 10, 2000

Related U.S. Application Data

(63) Continuation of application No. 09/363,023, filed on Jul. 29, 1999, now Pat. No. 6,085,631, which is a continuation-in-part of application No. 09/178,595, filed on Oct. 26, 1998, now Pat. No. 6,006,517.

(51) Int. Cl.[7] ..... F01B 21/02

(52) U.S. Cl. ..... 91/325; 92/240

(58) Field of Search ..... 91/325; 92/240

(56) References Cited

U.S. PATENT DOCUMENTS

| | | | |
|---|---|---|---|
| Re. 29,497 | 12/1977 | Freitag . | |
| 2,545,586 | 3/1951 | Pollak . | |
| 2,846,190 | 8/1958 | Saurenman . | |
| 2,943,417 | 7/1960 | Greenspan et al. . | |
| 3,232,001 | 2/1966 | Stanzel . | |
| 3,310,024 | 3/1967 | McConnell . | |
| 3,739,764 | 6/1973 | Allport . | |
| 4,159,705 | 7/1979 | Jacoby . | |
| 4,329,806 | 5/1982 | Akiyama et al. . | |
| 4,355,564 | 10/1982 | Gidlund | 91/217 |
| 4,599,864 | 7/1986 | Neukomm | 60/671 |
| 4,614,085 | 9/1986 | Neukomm | 60/370 |
| 4,766,802 | 8/1988 | Caenazzo et al. | 91/394 |
| 4,885,978 | 12/1989 | Caenazzo et al. | 91/232 |
| 5,042,365 | 8/1991 | Rosman . | |
| 5,079,997 | 1/1992 | Hong . | |

(List continued on next page.)

FOREIGN PATENT DOCUMENTS

| | | |
|---|---|---|
| 151313 | 5/1904 | (DE) . |
| 151314 | 5/1904 | (DE) . |
| 0151313 | 8/1985 | (EP) . |
| 0151314 | 8/1985 | (EP) . |

OTHER PUBLICATIONS

Aeromodler, Lotta Bottle, Apr. 1990.

Aeromodler, Double UP, Nov. 1991.

Operating and Assembly Instructions for Russian "Junior" Flying Aircraft Model, 1991.

Ecological Air Propulsion, Z Model Jonathan, A Creation "Ecological Air Propulsion", Via Solferino 1—31020 Frescada (TV) Italy.

*Primary Examiner*—F. Daniel Lopez
(74) *Attorney, Agent, or Firm*—Roylance, Abrams, Berdo & Goodman, L.L.P.

(57) ABSTRACT

Within a piston cylinder of a pneumatic engine, the system includes a piston proportioned for complemental travel within a piston cylinder, the piston having a radial compression surface and elements for effecting the axial reciprocation of the piston within the piston housing. The system further includes a piston seal including an element for securement to the compression surface of the piston and an integrally dependent resilient annular skirt normally biased inwardly toward a longitudinal system axis, the skirt, in combination with the securement elements, defining a radius of less than that from the system axis to interior walls of the cylinder during low pressure (return stroke) phases of a work cycle of the pneumatic engine and, during high pressure/compression stroke phases, defining a radius greater than that from the system axis to the inner wall of the cylinder. The inward bias of the skirt is overcome causing axial and radial lifting of the skirt against inner walls of the cylinder to effect a piston seal of a high integrity during high pressure phases of the engine work cycle. No seal exists during low pressure phases, since the skirt is not yet expanded.

22 Claims, 5 Drawing Sheets

U.S. PATENT DOCUMENTS

| | | | | |
|---|---|---|---|---|
| 5,149,290 | | 9/1992 | Reveen . | |
| 5,529,527 | | 6/1996 | Watkins . | |
| 5,531,627 | | 7/1996 | Deal . | |
| 5,558,117 | | 9/1996 | McGuinness . | |
| 5,634,840 | | 6/1997 | Watkins . | |
| 6,085,631 | * | 7/2000 | Kownacki | 91/325 |

* cited by examiner

PISTON-TO-CYLINDER SEAL FOR A PNEUMATIC ENGINE

REFERENCE TO RELATED APPLICATION

The application is a continuation of application Ser. No. 09/363,023, entitled Piston-to-Cylinder Seal For a Pneumatic Engine, filed Jul. 29, 1999 now U.S. Pat. No. 6,085,631, which is a continuation-in-part of application Ser. No. 09/178,595, entitled Pneumatic Engine, filed Oct. 26, 1998 now U.S. Pat. No. 6,006,517.

BACKGROUND OF THE INVENTION

In the design of pneumatic engines, there has existed an historic problem of releasing "back pressure" caused by a return stroke of the engine piston after a firing or compression stroke has occurred. This problem has caused engine designers to employ complicated exhaust valves or to leave a clearance between the piston diameter and the cylinder diameter, so pressurized air could escape during the return stroke.

The mechanics of the pneumatic engine are very simple. When the piston is moving from the intake valve, it is in the compression stroke. When the piston is furthest away from the intake valve it exhausts any pressure left from the compression cycle. When the moving towards the intake valve, it is in the return cycle. This return cycle is where the piston's movement back to the firing position is critical; no pressure buildup should occur. In all designs only the inertia of the rotating components force the piston down during this cycle.

In the prior art, there exist pneumatic engines without a seal on the piston. These designs do not create back-pressure but are very inefficient during the compression stroke because of air loss between the piston and the cylinder wall. If an O-ring type seal, or any seal that seals in both direction, is used between the piston diameter and the cylinder diameter, the compression stroke becomes very inefficient since any compressed air would then exhaust at the top of the stroke. However, when the piston is returning to its firing position it can create up to 5 five atmospheres of back-pressure before the firing sequence begins again. This effect slows down the rotational speed of the rotating components. Thus more inertia and heavier parts such as flywheels are needed to compensate. These effects in other engines that create back-pressure requires an exhaust valve to vent this pressure. If no exhaust valve is used, such seals significantly lower the performance of the engine, and in some cases cause the engine not to function.

The present invention is therefore directed to an engine seal adapted to seal against the piston wall only during the compression stroke, but not during the return stroke, thereby obviating the need for either an exhaust valve or higher mass engine components.

SUMMARY OF THE INVENTION

Within a piston cylinder of a pneumatic engine, the inventive system comprises a piston proportioned for complemental travel within said piston cylinder, said piston having a radial compression surface thereof and means for effecting the axial reciprocation of said piston within said piston housing. The system further includes a piston seal including means for securement to said compression surface of said piston and an integrally dependent resilient annular skirt normally biased inwardly toward a longitudinal system axis, said skirt, in combination with said securement means, defining a radius of less than that from said system axis to interior walls of said cylinder during low pressure (return stroke) phases of a work cycle of the pneumatic engine and, during high pressure (compression stroke) phases thereof, defining a radius equal to that from the system axis to said inner wall of said cylinder. Therein, said inward bias of said skirt is overcome thereby causing axial and radial lifting of the skirt against inner walls of the cylinder, to effect a piston seal of a high integrity during high pressure phases of the engine work cycle. During low pressure phases, no seal is effected since the skirt has not yet expanded.

The piston seal more particularly includes a hollow cylindrical segment having an interior diameter complemental with an outside diameter of the piston to be sealed oppositely to the compression region of the engine cylinder. An upper base of the hollow cylindrical segment defines, in part, a surface which is complemental to lower annular surfaces of said piston which are radially inward from the inside diameter of the cylinder. The inventive includes, radially outwardly from said upper base of said cylindrical segment, an integrally dependent resilient annular umbrella-like skirt having a radial extent, when measured from the system axis, which is normally less than the radius from said axis to the outside diameter of the piston. Therein, the annular skirt in normally biased inwardly toward the system axis and radially away from the cylinder wall in which interface. Therefore sealing of said skirt against the cylindrical wall will occur only in the presence of elevated fluid pressure beneath the skirt which causes an axial lifting, and thereby radial expansion, of said skirt bringing the periphery thereof into fluid tight deformable contact with said wall of said cylinder during high pressure phases of the work cycle of the pneumatic engine.

It is accordingly an object of the present invention to provide an improved compression seal for a cylinder of a pneumatic engine.

It is another object to provide an improved piston-cylinder system, inclusive of a pneumatic piston seal, which will provide improved fluid integrity at the piston-cylinder interface during compression strokes of the engine.

It is a further object of the invention to provide a method of unsealing of a piston of a pneumatic engine during return strokes thereof.

It is a still further object to provide a piston seal for a pneumatic engine of a type particularly adapted for use with toy vehicles.

It is a further object to provide a piston seal of the above type which does not require manufacture thereof integrally with the manufacture of the piston of such an engine and does not require use of a return valve or high mass engine components.

The above and yet other objects and advantages of the present invention will become apparent from the hereinafter set forth Brief Description of the Drawings, Detailed Description of the Invention, and Claims appended herewith.

DETAILED DESCRIPTION OF THE INVENTION

Figure 1:
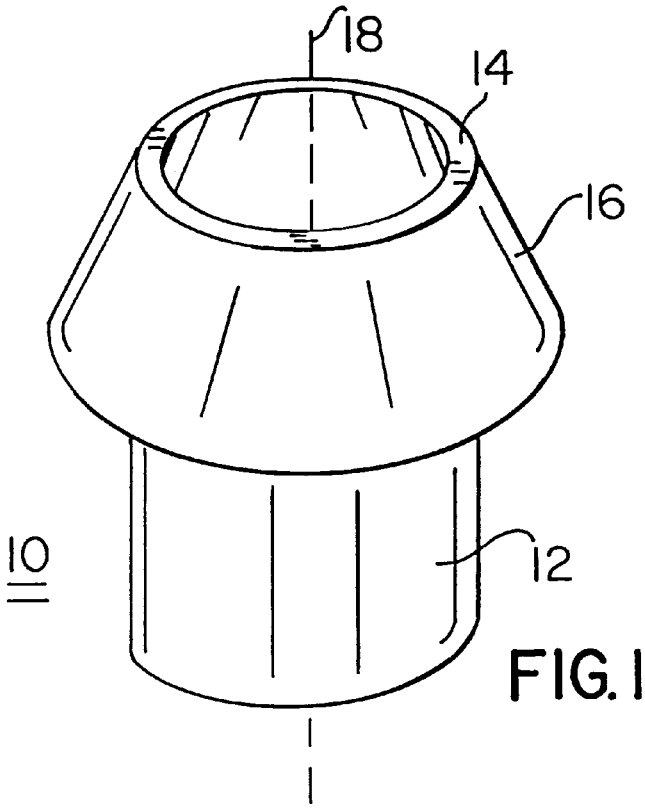
FIG. 1 is a perspective view of the inventive piston seal.

With reference to the perspective view of FIG. 1, an inventive piston seal 10 may be seen to include a substantially cylindrical sleeve 12 including, integrally dependent from a radial base 14, an annular skirt 16. As may be noted, said cylindrical sleeve 12 and annular skirt 16 are polarly symmetric about a longitudinal axis 18 thereof, also referred to herein as a system axis. The transverse width of skirt 16 is about one-half the width or thickness of the sleeve 12.

Figure 2:
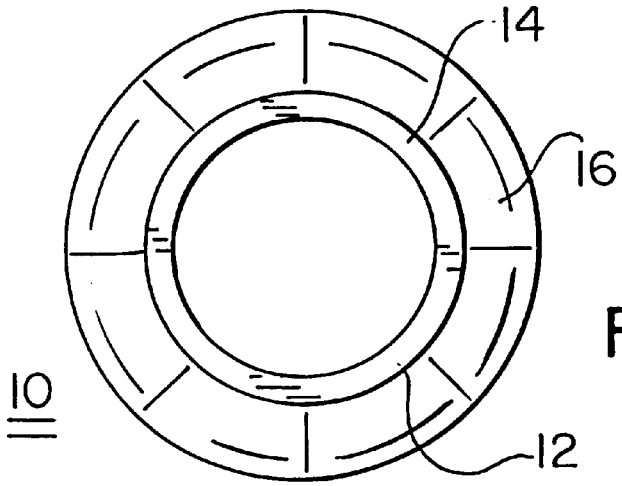
FIG. 2 is a top view thereof.

A top view of the seal is shown in FIG. 2.

Figure 3:
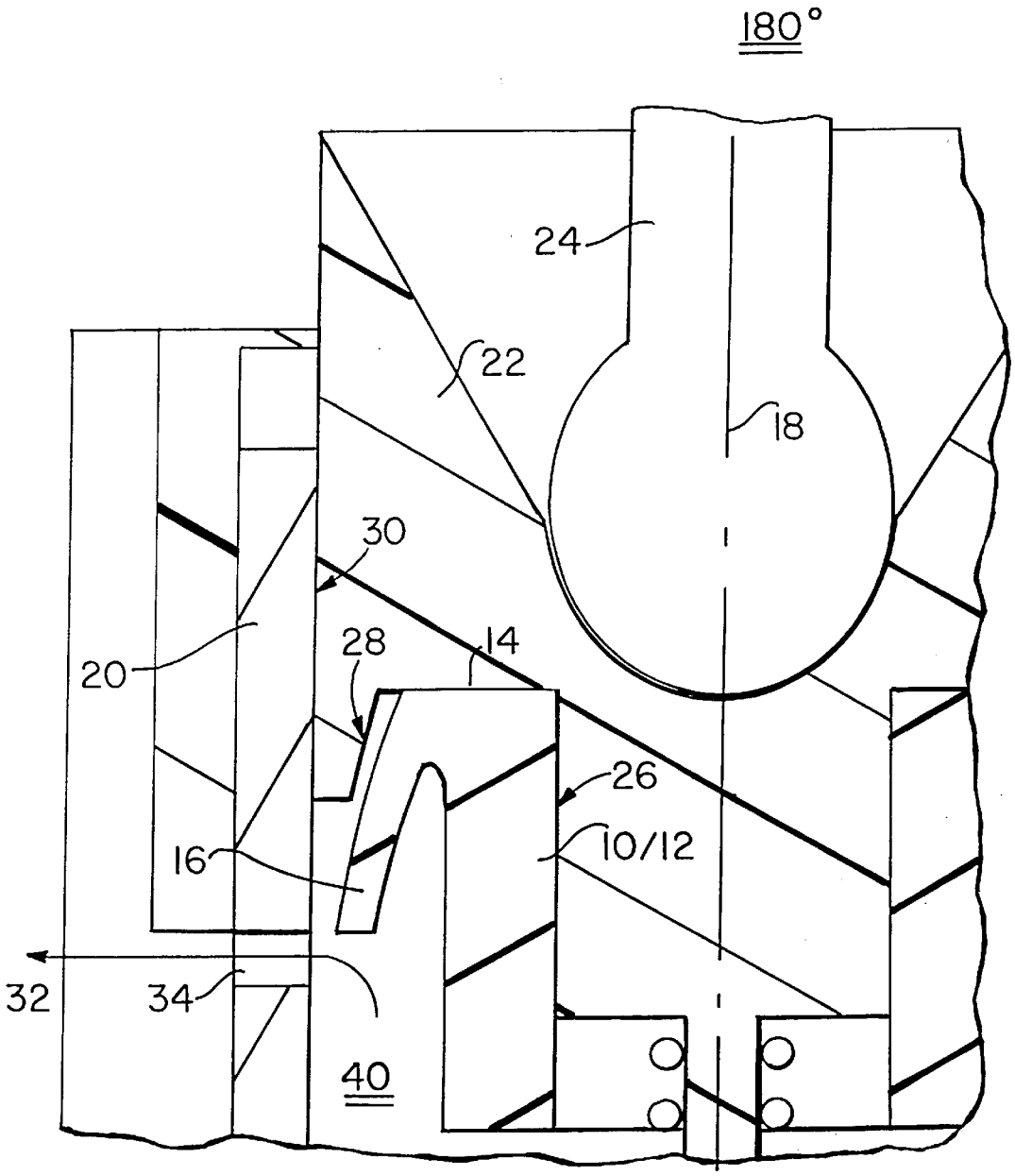
FIG. 3 is an operational view of the piston seal showing the same at the beginning of a low pressure phase (return stroke) of a pneumatic engine work cycle.

With reference to the enlarged view of FIG. 3, there may be seen further elements which comprise the instant inventive piston compression/description system for use in a pneumatic engine. More particularly, FIG. 3 includes a cross-sectional view of a piston cylinder 20 of a pneumatic engine and a piston 22 which is proportioned for complemental travel therewith. As may be noted, the system also includes a piston rod 24 which comprises means for effecting the axial reciprocation of the piston 22 within the piston cylinder 20. It is to be understood that the illustrated piston constitutes but one of numerous geometries to which the present invention is applicable.

FIG. 3 further shows a radial compression surface 26 of said piston 22. Against substantially all of this surface, with the exception of outer annular region 28, said piston seal 10 is complementally or, otherwise as by bonding means, secured. Thereby, the interior diameter of cylindrical sleeve 12 of the seal 10 as well as radial base 14 thereof will be secured, this leaving only resilient annular skirt 16 without direct securement to compression surface 26 of the piston 22. It is to be noted that skirt 16 of seal 10 is normally biased inwardly toward system axis 18 such that, during a low pressure phase or return stroke of the work cycle (which is shown in FIG. 3) of the pneumatic engine, skirt 16 will exhibit the geometry shown therein. That is, skirt 16 will not touch interior wall 30 of the piston cylinder 20. In the view of FIG. 3, this geometry is shown permits the escape of air 32 through cylinder aperture 34.

During a high pressure phase or compression stroke of the work cycle of the pneumatic engine, the piston and piston seal are lower within piston cylinder 20 and are moving upward relative to bottom surface 36 of the piston cylinder. See FIG. 4. Therein high pressure air bursts 38 and 38*a* create a high pressure region 40 within cylinder 20 thereby applying sufficient axial and radial pressure against the underside of skirt 16 to overcome said inward bias. When this occurs, the upper surface of skirt 16 will deformably urge against wall 30 of the cylinder thereby creating a high pressure, high integrity annular seal within region 42, between said surface 30 of cylinder 20, said skirt 16 of seal 10 and an annular interface region 44 of the piston 22. Therein, it is noted that while the radius of skirt 16 relative to system axis 18 is normally less than the radius of cylinder wall 30 therefrom, during high pressure phases of the engine work cycle, such as that shown in FIG. 4, the radius of skirt 16 will be forcibly increased, by the effect of air burst 38*a*, to one which is equal to the radius of wall 30, thereby, in combination with the deformable property of said seal 10, creating the above-referenced high pressure high intensity seal within annular region 42 of the system.

Figure 4:
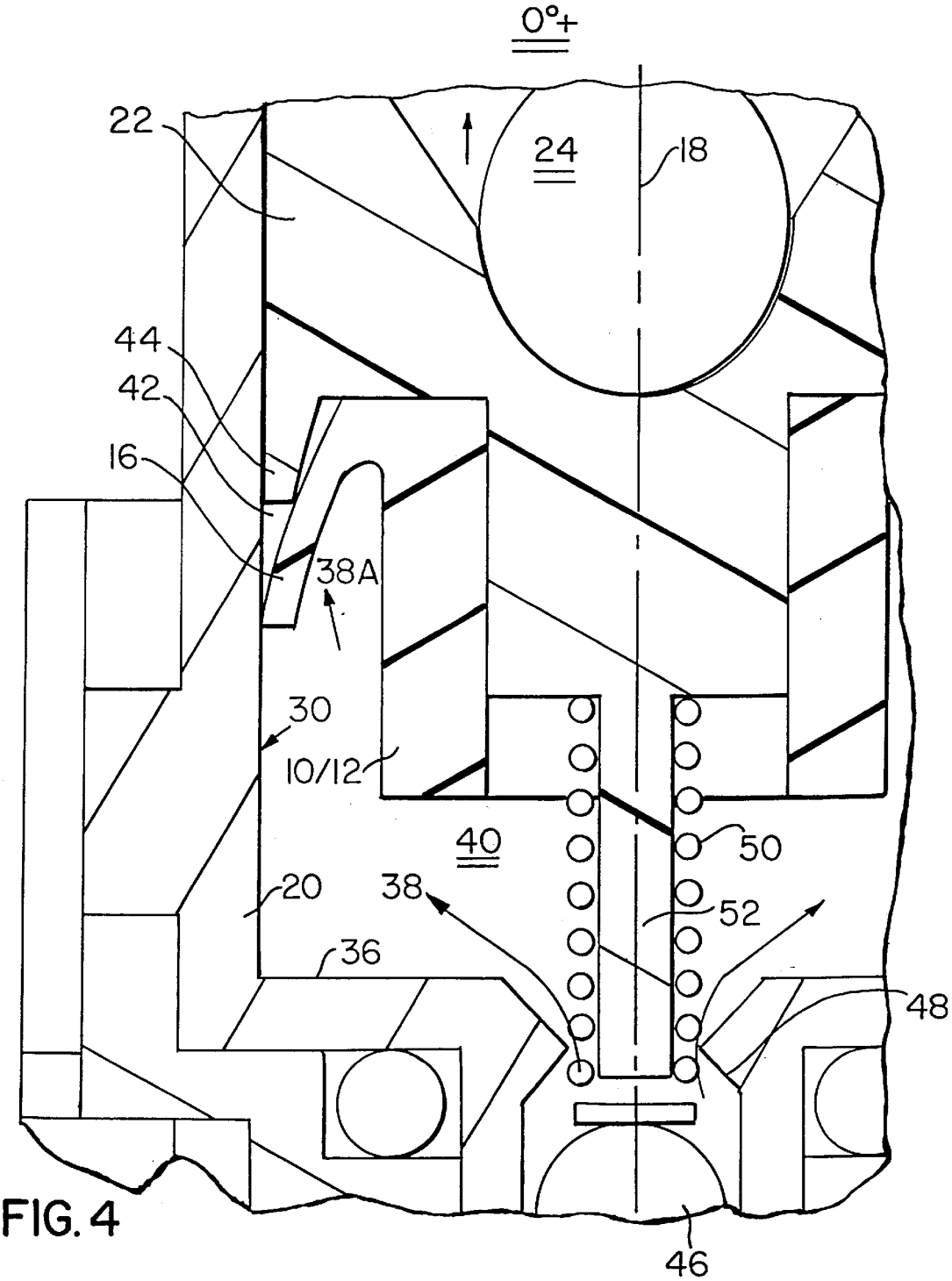
FIG. 4 is an operational view of the piston seal showing the same at the beginning of a high pressure (compression stroke) phase of the engine work cycle.
Figure 6:
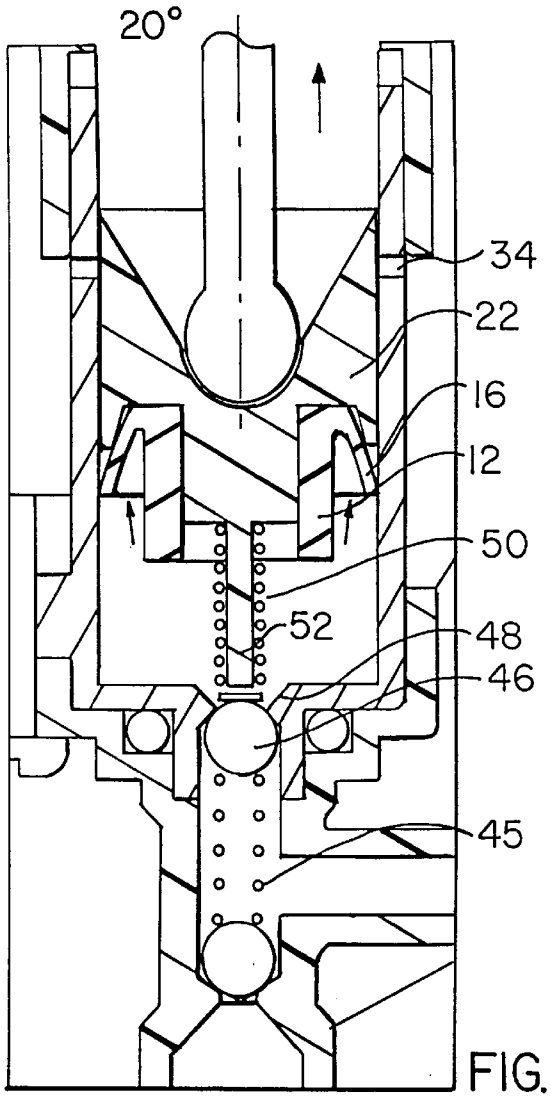
FIG. 6 is a view, similar to the view of FIG. 5, however showing the piston in its comparison stroke, however advanced twenty degrees within the engine cycle from the position of FIG. 5.
Figure 5:
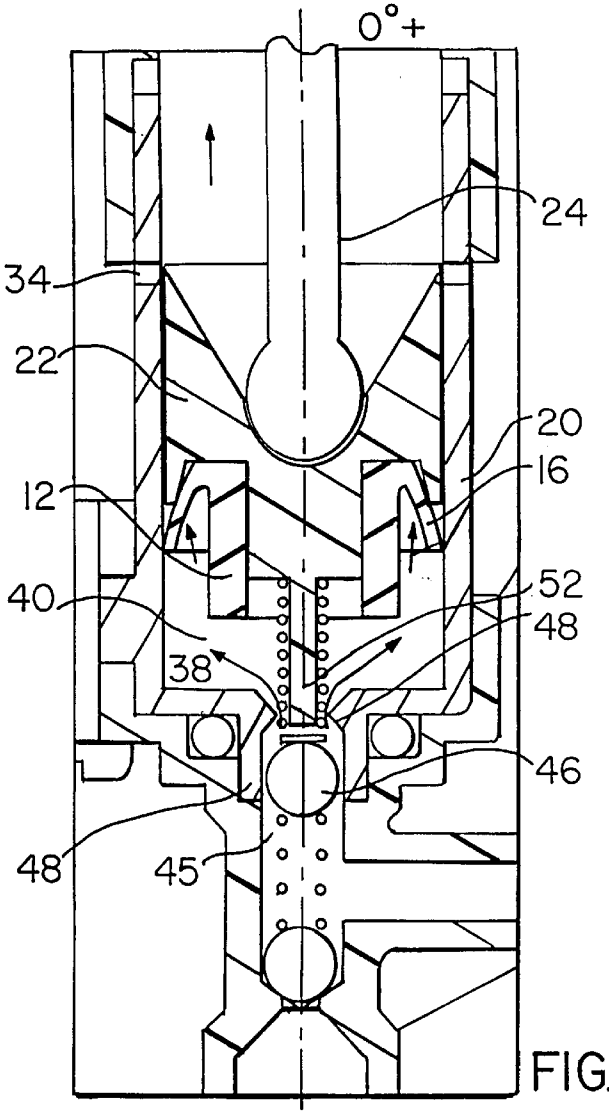
FIGS. 5 is a view, similar to the view of FIG. 4, however showing the entire piston, piston seal, cylinder and air inlet assembly.

With reference to the relationship of the views of FIGS. 3 and 4 to an entire work cycle of a pneumatic engine of a type to which the present invention is applicable, there is shown in FIG. 5 a view of an entire piston, cylinder and associated air inlet 45 assembly for a pneumatic engine to which the present invention is applicable. Therein, FIG. 5 (which corresponds to that of FIG. 4) show a high compression phase of the engine work cycle, that is, the part of the work cycle during which piston 22 is moving upward but has not yet reached cylinder apertures 34 through which air is released. In FIG. 6, inlet ball 46 is closed relative to cylinder inlet 48. Also spring 50, which rests on rod 52, is shown in the process of pushing off of ball 46 to impart kinetic energy to piston 22.

Figure 7:
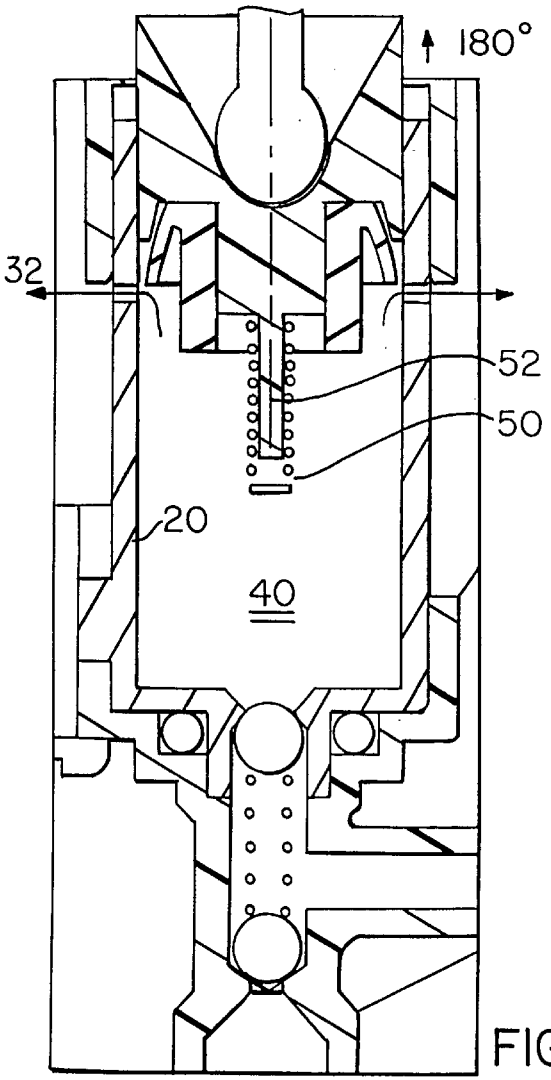
FIG. 7 is a system view, similar to the views of FIGS. 5 and 6, however showing the piston and associated seal in a low pressure phase of the engine cycle corresponding to that of FIG. 3.

The view of FIG. 7 corresponds to that of FIG. 3. This phase of the work cycle corresponds to the point of lowest internal compression within the cylinder 20, i.e., the return stroke.

Figure 8:
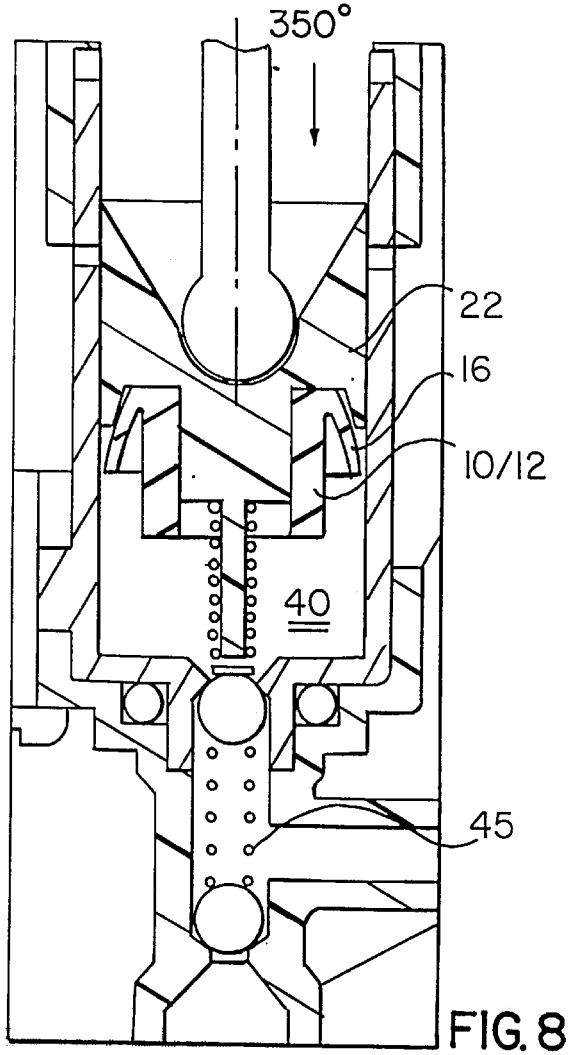
FIG. 8 is a system view similar to that of FIGS. 5 through 7, however, showing a near-completed down or return stroke of the system, in which a high pressure phase had not yet been reached.

In FIG. 8 is shown the downward motion of piston 22, however, before sufficient pressure has been reached within region 40 to overcome the inward bias of piston seal skirt 16 toward axis 18 of the system. Accordingly, during the phases of the work cycle shown in FIGS. 7 and 8, the skirt 16 maintains its normally closed inward biased (also shown in FIG. 1), thereby permitting escape of air within region 40 in order to release back pressure that would otherwise develop therein. Thereby, maximum engine efficiency is obtained.

While there has been shown and described the preferred embodiment of the instant invention it is to be appreciated that the invention may be embodied otherwise than is herein specifically shown and described and that, within said embodiment, certain changes may be made in the form and arrangement of the parts without departing from the underlying ideas or principles of this invention as set forth in the claims appended herewith.

Having thus described my invention what I claim as new, useful and non-obvious and, accordingly, secure by Letters Patent of the United States is:

1. A compression seal system for a pneumatic engine, the seal system comprising:

a cylinder having an inner wall with an innermost diameter and an end wall;

a piston positioned within said cylinder and having an outer diameter which is less than said innermost diameter of said cylinder, said piston extending across said innermost diameter of said cylinder;

a pulsating pneumatic input introduced into said cylinder; and a seal including a resilient annular skirt coupled to said piston, said skirt spaced from said end wall when said pulsating pneumatic input is introduced to said cylinder;

whereby, said pulsating pneumatic input urges a portion of said skirt outwardly to initially form a fluid seal with said inner wall of said cylinder to move said piston, and said innermost diameter of said cylinder being a substantially uniform innermost diameter along a length of said cylinder that touches said skirt during movement of said seal.

2. A piston seal for a pneumatic engine, the combination comprising:

a cylinder having an inner wall with an innermost diameter and at least one exhaust aperture extending through said cylinder inner wall;

a piston with an outer surface positioned adjacent said inner wall of said cylinder and adapted to move relative to said cylinder in at least a compression stroke and a return stroke; and a resilient annular skirt coupled to said piston and normally spaced from said inner wall of said cylinder, a first portion of said skirt adapted to be biased radially outwardly and into contact with said inner wall of said cylinder during movement of said piston in said compression stroke, and at least one of said first portion and a second portion of said skirt adapted to move at least partially past said at least one aperture;

said innermost diameter of said cylinder being substantially uniform along a length of said inner wall of said cylinder that contacts said portion of said skirt during movement of said piston in said compression stroke.

3. A piston seal according to claim 2, including means for biasing said skirt radially outwardly, said means including means for introducing a high pressure fluid into said cylinder.

4. A piston seal according to claim 3, wherein said piston engages a projection on a lower surface of said piston, said projection extending beyond a lowermost portion of said seal and adapted to open a valve, and thereby introduce said high pressure fluid.

5. A piston seal according to claim 4, wherein said projection has an outer surface, said outer surface having a spring adjacent to at least a portion thereof.

6. A piston seal according to claim 3, wherein said high pressure fluid is air.

7. A piston seal according to claim 2, wherein said piston is spaced from said cylinder.

8. A piston seal according to claim 2, wherein said piston is positioned within said cylinder during movement of said piston.

9. A piston seal for a pneumatic engine, the combination comprising:

a cylinder having an inner wall with an innermost diameter and a end wall;

a piston with an outer surface positioned within said cylinder and spaced from said inner wall of said cylinder, said piston being adapted to move relative to said cylinder in at least a compression stroke and a return stroke; and a resilient annular skirt coupled to said piston, said skirt spaced from said inner wall and said end wall of said cylinder until a portion of said skirt is biased radially outwardly and into contact with said inner wall of said cylinder due to high pressure air being introduced into said cylinder;

said innermost diameter of said cylinder being substantially uniform along a length of said inner wall of said cylinder that contacts said portion of said skirt during movement of said skirt in said compression stroke.

10. A piston seal according to claim 9, wherein said piston engages a projection on a lower surface of said piston, said projection extending beyond a lowermost portion of said seal and adapted to open a valve, and thereby introduce said high pressure air.

11. A piston seal according to claim 10, wherein said projection has an outer surface, said outer surface having a spring adjacent to at least a portion thereof.

12. A method for sealing a piston positioned in a cylinder of a pneumatic engine, the piston having a first outer diameter and a resilient annular skirt with an outer periphery coupled to a portion of the piston, the cylinder having a inner wall with an inner diameter and at least one exhaust aperture extending through the cylinder inner wall, the method comprising the steps of introducing a high pressure fluid into the cylinder;

forming a substantially fluid tight seal between the skirt and the inner wall of the cylinder by outwardly deforming the skirt in response to the introduction of the high pressure fluid;

moving the piston and the skirt relative to the cylinder, with a first portion of the skirt contacting the inner wall of the cylinder, and maintaining the fluid tight seal between the skirt and the inner wall of the cylinder and maintaining the annular skirt outer periphery in substantially the same radial position, at least one of the portion and a second portion of the skirt adapted to move at least partially past the at least one aperture;

exhausting the high pressure fluid out of the cylinder through the at least one, exhaust aperture;

retuning the skirt to an undeformed condition; and moving the piston and skirt relative to the cylinder, and allowing passage of fluid between the piston and the cylinder inner wall, and between the skirt and the cylinder wall.

13. A method according to claim 12 wherein p1 the second step of moving the piston and skirt relative to the piston cylinder includes opening a valve to introduce additional high pressure fluid into the cylinder.

14. A compression seal system for a pneumatic engine, the seal system comprising:

a cylinder having an inner wall with an innermost diameter and an end wall, a piston positioned within said cylinder and having an outer diameter which is less than said innermost diameter of said cylinder, said piston extending across said innermost diameter of said cylinder;

a pulsating pneumatic input introduced to said cylinder; and a seal including a resilient annular skirt coupled to said piston, said skirt spaced from said end wall and said inner wall when said pulsating pneumatic input is introduced to said cylinder;

whereby said pulsating pneumatic input urges a portion of said skirt outwardly to initially form an air seal with said inner wall of said cylinder to move said piston.

15. A piston seal according to claim 14, wherein said piston engages a projection on a lower surface of said piston, said projection extending beyond a lowermost portion of said seal and adapted to open a valve, and thereby introduce said pulsating pneumatic input.

16. A piston seal according to claim 15, wherein said projection has an outer surface, said outer surface having a spring adjacent to at least a portion thereof.

17. A piston seal for a pneumatic engine, the combination comprising:

a cylinder having an inner wall with an innermost diameter and at least one exhaust aperture extending through said cylinder inner wall;

a piston with an outer surface positioned adjacent said inner wall of said cylinder and adapted to move relative to said cylinder in at least a compression stroke and a return stroke; and a resilient annular skirt coupled to said piston and normally spaced from said inner wall of said cylinder, a first portion of said skirt adapted to be biased radially outwardly and into contact with said inner wall of said cylinder during movement of said piston in said compression stroke, at least one of said first portion and a second portion of said skirt adapted to move at least partially past said at least one aperture.

18. A piston seal according to claim 17, wherein said piston engages a projection on a lower surface of said piston, said projection extending beyond a lowermost portion of said seal and adapted to open a valve, and thereby introduce a high pressure fluid.

19. A piston seal according to claim 18, wherein said projection has an outer surface, said outer surface having a spring adjacent to at least a portion thereof.

20. A piston seal for a pneumatic engine, the combination comprising:

a cylinder having an inner wall with an innermost diameter and a end wall;

a piston with an outer surface positioned within said cylinder and spaced from said inner wall of said cylinder, said piston being adapted to move relative to said cylinder in at least a compression stroke and a return stroke; and a resilient annular skirt coupled to said piston, said skirt spaced from said inner wall and said end wall of said cylinder until a portion of said skirt is biased radially outwardly and into contact with said inner wall of said cylinder due to high pressure air being introduced into said cylinder.

21. A piston seal according to claim 20, wherein said piston engages a projection on a lower surface of said piston, said projection extending beyond a lowermost portion of said seal and adapted to open a valve, and thereby introduce said high pressure air.

22. A piston seal according to claim 21, wherein said projection has an outer surface, said outer surface having a spring adjacent to at least a portion thereof.

* * * * *

UNITED STATES PATENT AND TRADEMARK OFFICE

CERTIFICATE OF CORRECTION

PATENT NO. : 6,230,605 B1
DATED : May 15, 2001
INVENTOR(S) : Charles D. Kownacki It is certified that error appears in the above-identified patent and that said Letters Patent is hereby corrected as shown below:

Column 6, claim 13,
Lines 33-36, please amend to read:

-- 13. A method according to claim 12 wherein the second step of moving the piston and skirt relative to the piston cylinder includes opening a valve to introduce additional high pressure fluid into the cylinder. --

Signed and Sealed this

Twenty-sixth Day of March, 2002

*Attest:*

*Attesting Officer*

JAMES E. ROGAN
*Director of the United States Patent and Trademark Office*